US005462453A

United States Patent [19]

Muller

[11] Patent Number: 5,462,453

[45] Date of Patent: Oct. 31, 1995

[54] ELECTRICAL CONNECTOR FOR BATTERY TERMINALS

[75] Inventor: Fabien Muller, Hundling, France

[73] Assignee: Delphi France Automotive Systems, Gennevilliers, France

[21] Appl. No.: 234,815

[22] Filed: Apr. 28, 1994

[30] Foreign Application Priority Data

May 1, 1993 [GB] United Kingdom ..... 9309096

[51] Int. Cl.[6] ..... H01R 4/42

[52] U.S. Cl. ..... 439/510; 439/504; 439/759

[58] Field of Search ..... 439/754, 759, 439/763, 754, 755, 756, 757, 758, 759, 760, 761, 762, 763, 764, 502, 503, 504, 510, 627

[56] References Cited

U.S. PATENT DOCUMENTS

| | | | |
|---|---|---|---|
| 1,420,435 | 6/1922 | Marko | 439/760 X |
| 1,845,501 | 2/1932 | Jurad | 439/759 OR |
| 1,854,489 | 4/1932 | Sebell . | |
| 3,529,280 | 9/1970 | Best | 439/757 OR |
| 4,464,008 | 8/1984 | Andersson et al. | 439/754 X |
| 4,815,991 | 3/1989 | Bakke | 439/502 OR |

FOREIGN PATENT DOCUMENTS

| | | |
|---|---|---|
| 2688945 | 9/1993 | France . |
| 4174966 | 6/1992 | Japan . |
| 1372834 | 11/1974 | United Kingdom . |
| 1514988 | 6/1978 | United Kingdom . |

*Primary Examiner*—David L. Pirlot
*Assistant Examiner*—Daniel Wittels
*Attorney, Agent, or Firm*—Lawrence B. Plant

[57] ABSTRACT

An electrical connector for a battery terminal having a known minimum diameter, comprising an electric contact of electrically conductive material having a substantially U-shaped cross-section defined by a base portion and a pair of resilient legs extending away from the base portion, the free end of each leg being bent inwardly to form an arm which is directed back towards the base portion, the pair of arms being resilient, spaced apart to define a longitudinally extending slot therebetween, and converging such that the slot has a predetermined inner width which is less than a predetermined outer width, the predetermined outer width of the slot being greater than the minimum diameter of the battery terminal, and the predetermined inner width of the slot being less than the minimum diameter of the battery terminal; and a housing of electrically insulating material which surrounds the electric contact and which has an opening adjacent the slot through which the battery terminal can pass.

9 Claims, 8 Drawing Sheets

ELECTRICAL CONNECTOR FOR BATTERY TERMINALS

This invention relates to an electrical connector for battery terminals, and in particular to an electrical connector for electrically connecting terminals having a substantially cylindrical or frusto-conical shape.

BACKGROUND OF THE INVENTION

The charging of batteries, for example, lead-acid batteries, during manufacture thereof is usually performed at a charging station. At the charging station, a plurality of batteries are placed substantially adjacent one another in a line with the adjacent terminals of adjacent batteries having opposite polarity. Adjacent terminals are electrically connected together to electrically connect the batteries in series, to allow the plurality of batteries to be charged at the same time. Adjacent terminals are connected by an electrical connector comprising a substantially U-shaped copper plate in which the arms of the plate are resiliently biased away from one another. This type of electrical connector is placed in position by squeezing the arms together, placing the connector between adjacent terminals, and then releasing the arms. The free ends of the arms are biased into contact with the adjacent terminals. This type of electrical connector has several disadvantages. Firstly, the design of the connector is such that a point contact is made between the connector and the terminals. On charging there is a high risk that the terminal will burn, especially if any dirt is present. Secondly, this type of connector provides no form of protective housing around the terminals, thereby exposing the terminals to the environment. With lead-acid batteries, presence of sulphuric acid can cause blackening of lead terminals due to the formation of lead oxide. Further, the use of copper is unsuitable as the connector easily breaks, and in an acid environment, the copper is subject to degradation.

It is an object of the present invention to overcome one or more of the above disadvantages.

BRIEF DESCRIPTION OF THE INVENTION

To this end, an electrical connector in accordance with the present invention for a battery terminal having a known minimum diameter, comprises an electric contact of electrically conductive material having a substantially U-shaped cross-section defined by a base portion and a pair of resilient legs extending away from the base portion, the free end of each leg being bent inwardly to form an arm which is directed back towards the base portion, the pair of arms being resilient, spaced apart to define a longitudinally extending slot therebetween, and converging such that the slot has a predetermined inner width which is less than a predetermined outer width, the predetermined outer width of the slot being greater than the minimum diameter of the battery terminal, and the predetermined inner width of the slot being less than the minimum diameter of the battery terminal; and a housing of electrically insulating material which surrounds the electric contact and which has an opening adjacent the slot through which the battery terminal can pass.

With this arrangement, the electrical connector can be pushed onto the battery terminal. The battery terminal passes through the opening in the housing and into the slot in the electric contact. As the electrical connector is pushed onto the battery terminal, the battery terminal engages each arm to push the arms away from one another, and to push the legs away from one another, against their resilience. In this way, the electrical connector resiliently grips the battery terminal and provides contact between the battery terminal and the arms along a portion of the height of the battery terminal, overcoming the problems associated with a point contact as in the prior art. Further, after the electrical connector is pushed onto the battery terminal, the housing substantially surrounds both the electric contact and the battery terminal, thereby providing protection therefor from the environment. This is particularly advantageous during the charging of lead-acid batteries during which stage sulphuric acid vapours can be discharged into the environment.

Preferably, the electrical connector comprises two such electric contacts which are electrically connected together and substantially aligned in the longitudinal direction of the slots, the housing surrounding both electric contacts and having a single opening adjacent the slots or an opening adjacent each slot. This arrangement is used for electrically connecting adjacent terminals (of opposite polarity) on batteries which are substantially adjacent one another. The electric contacts may be substantially the same size for use with connecting battery terminals of substantially the same size. Alternatively, the electric contacts may be of slightly different sizes for use with connecting battery terminals of slightly different sizes.

As a further alternative, the electrical connector may comprise two such electric contacts which are electrically connected together, each electric contact having its own separate housing. In this case, the electric contacts are preferably electrically connected by a length of electric cable or wire. This arrangement is used for electrically connecting terminals (of opposite polarity) on batteries which are spaced apart from one another by a significant distance or which have terminals which are significantly different in size.

Preferably, the (or each) electric contact is formed in one piece from sheet metal. Where the electrical connector comprises two electric contacts and a single housing, the electric contacts are preferably integrally formed in one piece. The (or each) electric contact is preferably formed from stainless steel.

The (or each) housing is preferably moulded from plastics material (for example, PVC), and the (or each) housing preferably has an integral handle or a handle attached thereto.

Whilst the present invention has been described in relation to being suitable for attachment to battery terminals by hand, the simple push-fit/pull-release of the electrical connector lends itself to automated attachment/disconnection from the battery terminals.

DETAILED DESCRIPTION OF SPECIFIC EMBODIMENTS

The present invention will now be described, by way of example, with reference to the accompanying drawings, in which.

Figure 1:
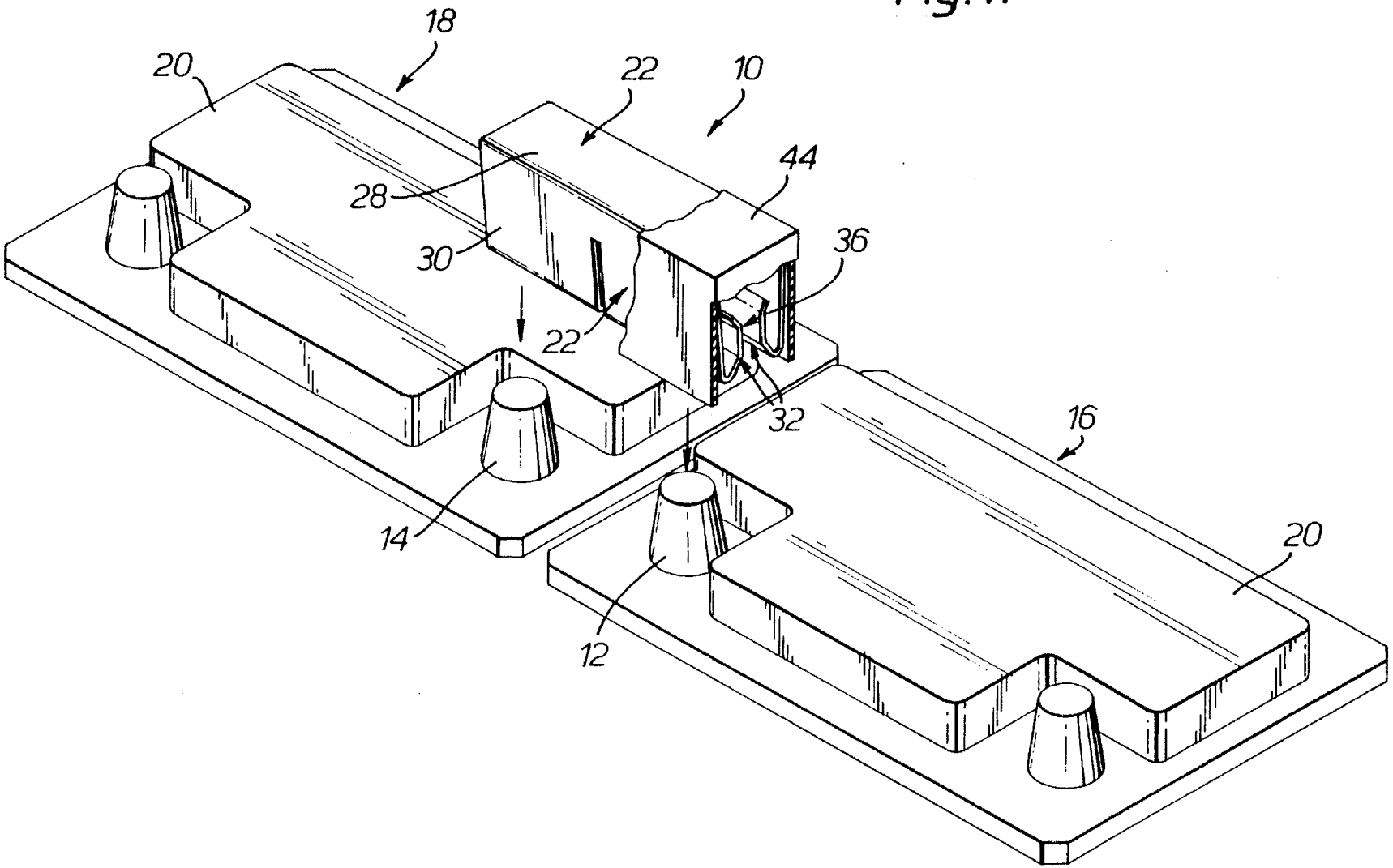
FIG. 1 is perspective view, partly cut-away, of an electrical connector in accordance with the present invention ready for connection to adjacent terminals on adjacent batteries (for ease of viewing, only the upper portion of the batteries is shown)
Figure 2:
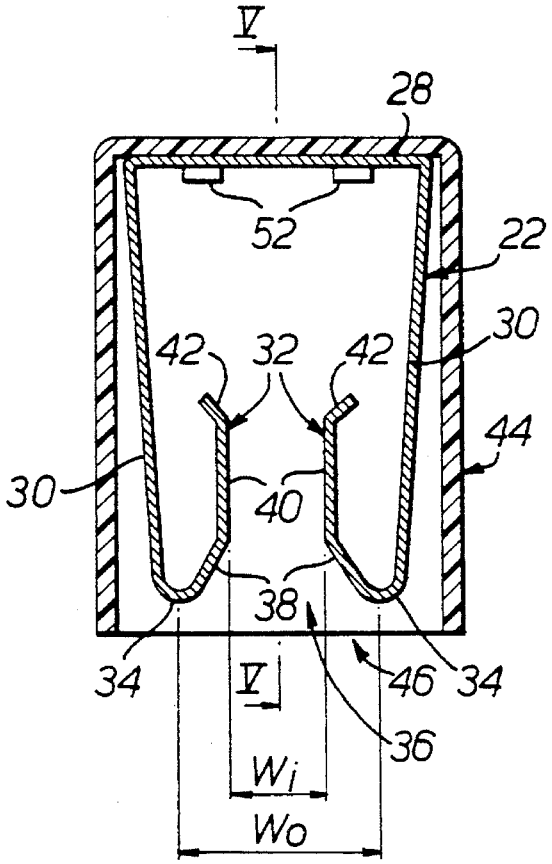
FIG. 2 is a cross-sectional view of the electrical connector shown in FIG. 1 taken on the line II—II of FIG. 5 prior to attachment to a battery terminal.

Referring to FIG. 1, an electrical connector 10 in accordance with the present invention is shown for electrically connecting adjacent terminals 12,14 on substantially adjacent batteries 16,18. The batteries 16,18 are of the lead-acid type, and only the upper portion 20 of the casing of each battery is shown. The terminals 12,14 are substantially cylindrical or frusto-conical in shape and have a known minimum diameter. Terminal 12 is of opposite polarity to terminal 14. The batteries 16,18 are part of a line of batteries ready for electrical connection in series at a charging station used in the manufacture of the batteries.

The electrical connector 10 will now be described in more detail with reference to FIGS. 2 to 8. The electrical connector 10 comprises a pair of electric contacts 22 which are substantially identical and which are integrally formed from a stamped sheet 24 of stainless steel (FIG. 8) which is subsequently folded into the required shape. Other types of metallic material could be used for the electric contacts, but stainless steel has been found to be the most suitable as the risk of breaking is substantially reduced, and it is less susceptible to degradation in an acid environment.

Figure 5:
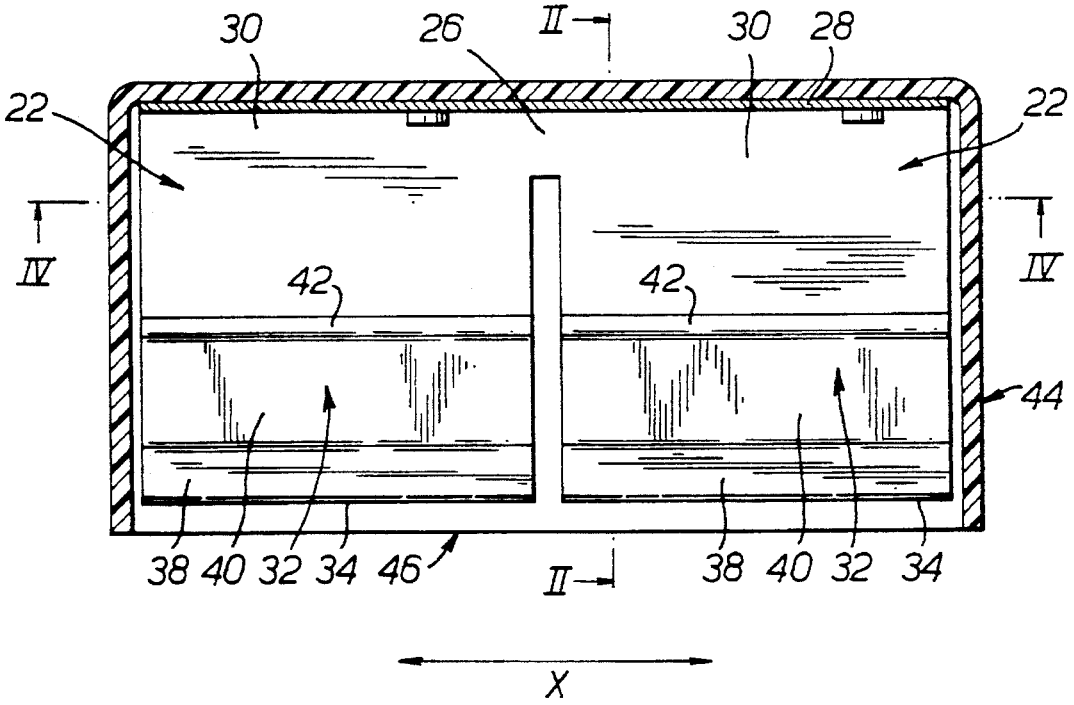
FIG. 5 is a cross-sectional view of the electrical connector shown in FIG. 1 taken on the line V—V of FIG. 2.
Figure 6:
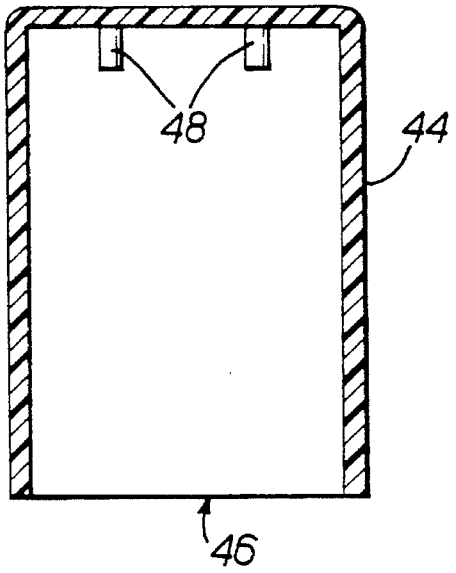
FIG. 6 is a cross-sectional view of the housing of the electrical connector of FIG. 1 prior to insertion of the electric contacts.
Figure 7:
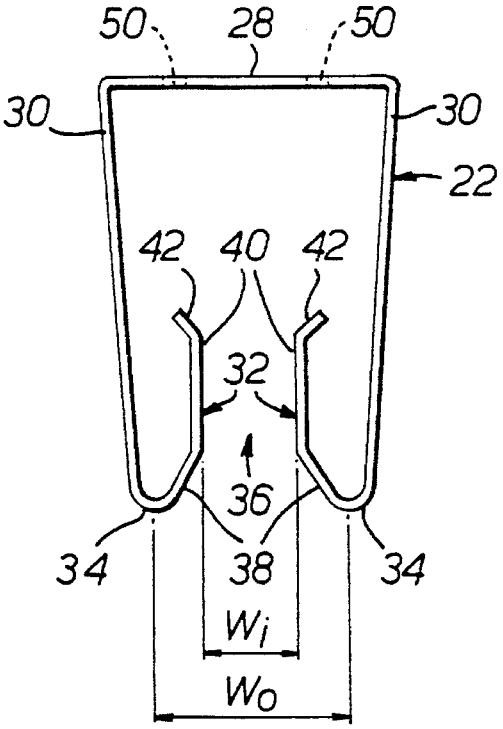
FIG. 7 is an end view of one of the electric contacts of the electrical connector of FIG. 1 prior to insertion in the housing.
Figure 8:
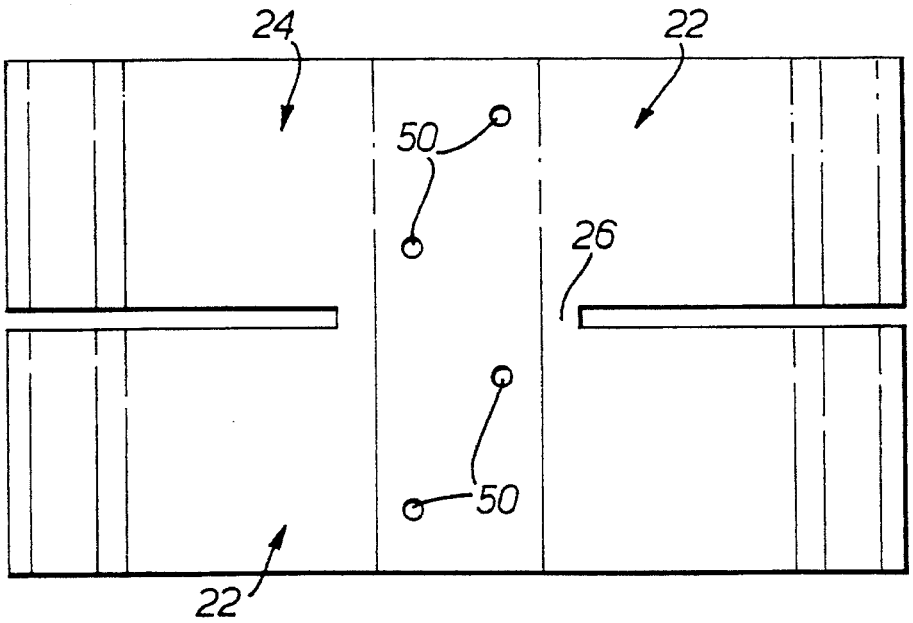
FIG. 8 is a top view of the electric contacts of the electrical connector of FIG. 1 cut from sheet material prior to folding or bending into the required shape.

The electric contacts 22 are connected by a portion 26 of the stamped sheet 24 (see FIG. 8). Each electric contact 22 has a substantially U-shaped cross-section comprising a base portion 28 and a pair of legs 30 which extend away from the base portion. In the non-connected state (FIGS. 2 and 7), the legs 30 converge towards one another in a direction away from the base portion 28. This arrangement provides the legs 30 with a resilient aspect. An arm 32 is formed at the free edge 34 of each leg 30. The arms 32 of each electric contact 22 are directed back towards the base portion 28 and are spaced apart to define a slot 36 which extends in a longitudinal direction X (FIG. 5). Each arm 32 comprises an outer portion 38, a central portion 40, and an inner portion 42. The outer portions 38 of the arms 32 of each electric contact 22 converge towards one another in a direction towards the base portion 28. The central portions 40, in the non-connected state, are either substantially parallel or slightly converge towards one another in the direction towards the base portion 28. This arrangement also provides the arms 32 with a resilient aspect. The inner portions 42 (which are optional) diverge away from one another in the direction of the base portion 28. The maximum separation of the outer portions 38 of the arms 32 of each electric contact 22, in the non-connected state, is set to define a predetermined outer width $W_o$ for the slot 36. The minimum separation of the central portions 40 of the arms 32 of each electric contact 22, in the non-connected state, is set to define a predetermined inner width $W_i$ for the slot 36. The predetermined outer width $W_o$ is determined such that it is greater than the minimum diameter of the terminal 12,14 to which the electric contact 22 is to be attached. Similarly, the predetermined inner width $W_i$ is determined such that it is less than the minimum diameter of the terminal 12,14 to which the electric contact 22 is to be fitted. The angles (in the non-connected state) of each leg 30 relative to the base portion 28; of the outer portion 38 of each arm 32 relative to its respective leg 30; of the central portion 40 relative to the outer portion; and of the inner portion 42 relative to the central portion; are also all predetermined and are preferably in the ranges 85° to 88°; 30° to 40°; 145° to 155°; and 150° to 160° respectively. The preferred angles are 87°; 36°; 150°; and 155° respectively. These angles are determined to provide the legs 30 and arms 32 with their resilient aspect such that an adequate contact pressure is applied to the terminal 12,14 when the electric contact 22 is connected thereto (FIG. 3), and also such that the electrical connector 10 can be easily pushed onto, and pulled off, the terminals 12,14. The angle given above for the leg 30 relative to the base portion 28 assumes that the base portion to be flat. Where the base portion is not flat, the angle is taken between the leg 30 and a plane though the connecting points of the legs to the base portion.

The electrical connector 10 also comprises a housing 44 which is preferably moulded in one piece from plastics material such as PVC. The housing 44 surrounds the electric contacts 22 and has an opening 46 which extends in the longitudinal direction X adjacent the slots 36. The housing 44 is formed with a number of pegs 48 which pass through corresponding apertures 50 in the base portions 28 of the electric contacts 22 when the electric contacts are positioned inside the housing. The free ends 52 of the pegs 48 are then rounded off or flattened (like rivets) to secure the electric contacts 22 inside the housing 44. Any other suitable means for securing each electric contact 22 inside the housing 44 could be used, for example, snap-fitting tangs, screws, adhesive, etc.

Figure 3:
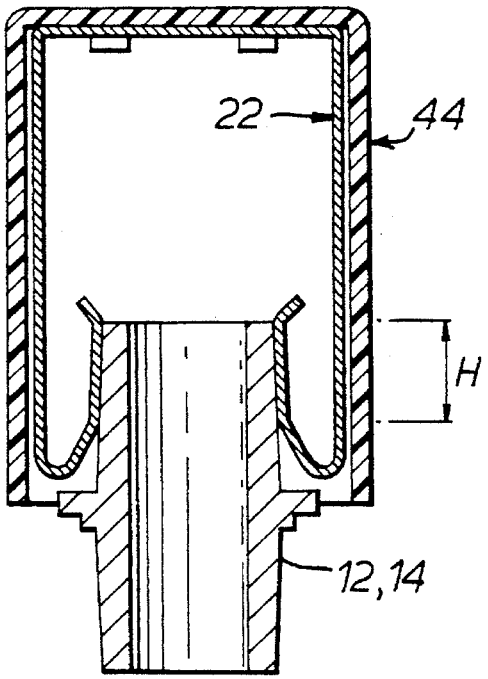
FIG. 3 is a similar view to that of FIG. 2, with the electrical connector fitted to a battery terminal.
Figure 4:
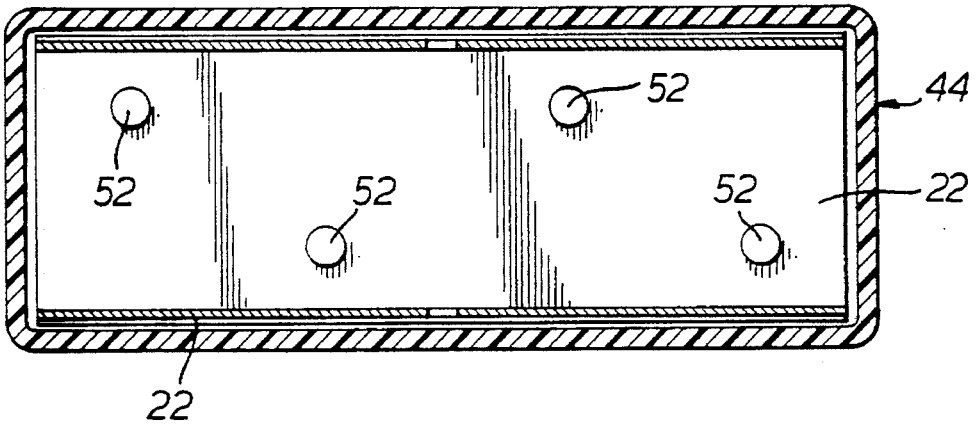
FIG. 4 is a cross-sectional view of the electrical connector shown in FIG. 1 taken on the line IV—IV of FIG. 5.

The electrical connector 10 is attached to the terminals 12,14 simply by pushing the electrical connector onto the terminals in the directions of the arrows shown in FIG. 1. Each terminal 12,14 enters the housing 44 through the opening 46 and passes between the outer portions 38 of the arms 32 of a respective electric contact 22 to engage the central portions 40 of the arms (FIG. 3). This action pushes the arms 32 away from one another and pushes the legs 30 away from one another. The resilience of the arms 32 and legs 30 exerts a biasing force on the terminal 12,14. This biasing force is applied to the terminal 12,14 along a portion H of the height of the terminal on circumferentially opposed sides of the terminal. This arrangement ensures that contact between the terminal 12,14 and its respective electric contact 22 is over an area which is significantly larger than a point contact, thereby significantly reducing the risk of burning the terminals 12,14. In this embodiment, the portion H of the height of the terminal 12,14 is substantially the same as the height of the central portion 40 of each arm 32, although this height may vary dependent on the width variations of the slot 36. The preferred value for H is 11 mm, although any value above 3 mm is acceptable. The biasing force acts to provide an adequate electrical connection between the terminal 12,14 and its respective electric contact 22, and also acts to hold the electrical connector 10 on the terminals. Once in position on the terminals 12,14, the housing 44 of the electrical connector 10 substantially surrounds both the electric contacts 22 and the terminals 12,14. This arrangements helps to protect the electric contacts 22 and the terminals 12,14 from degradation by the surrounding environment. The electrical connector 10 can be removed from the terminals 12,14 by simply pulling the electrical connector 10 off the terminals.

Figure 9:
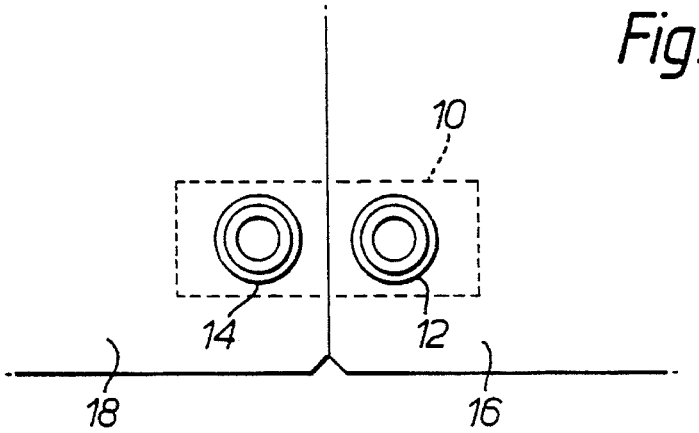
FIGS. 9 and 10 illustrate the use of the electrical connector with a range of distances between the adjacent terminals on adjacent batteries.
Figure 10:
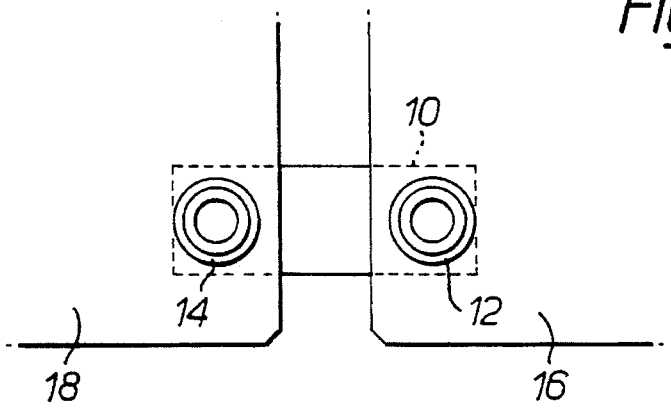

FIGS. 9 and 10 are views from above the batteries 16,18, with the electrical connector 10 shown in dashed outline. These Figures illustrate how the electrical connector can be used over a limited range of separations between adjacent terminals 12,14. It will also be appreciated that the electrical connector 10 can be used with terminals which are slightly different in shape and size.

Figure 11:
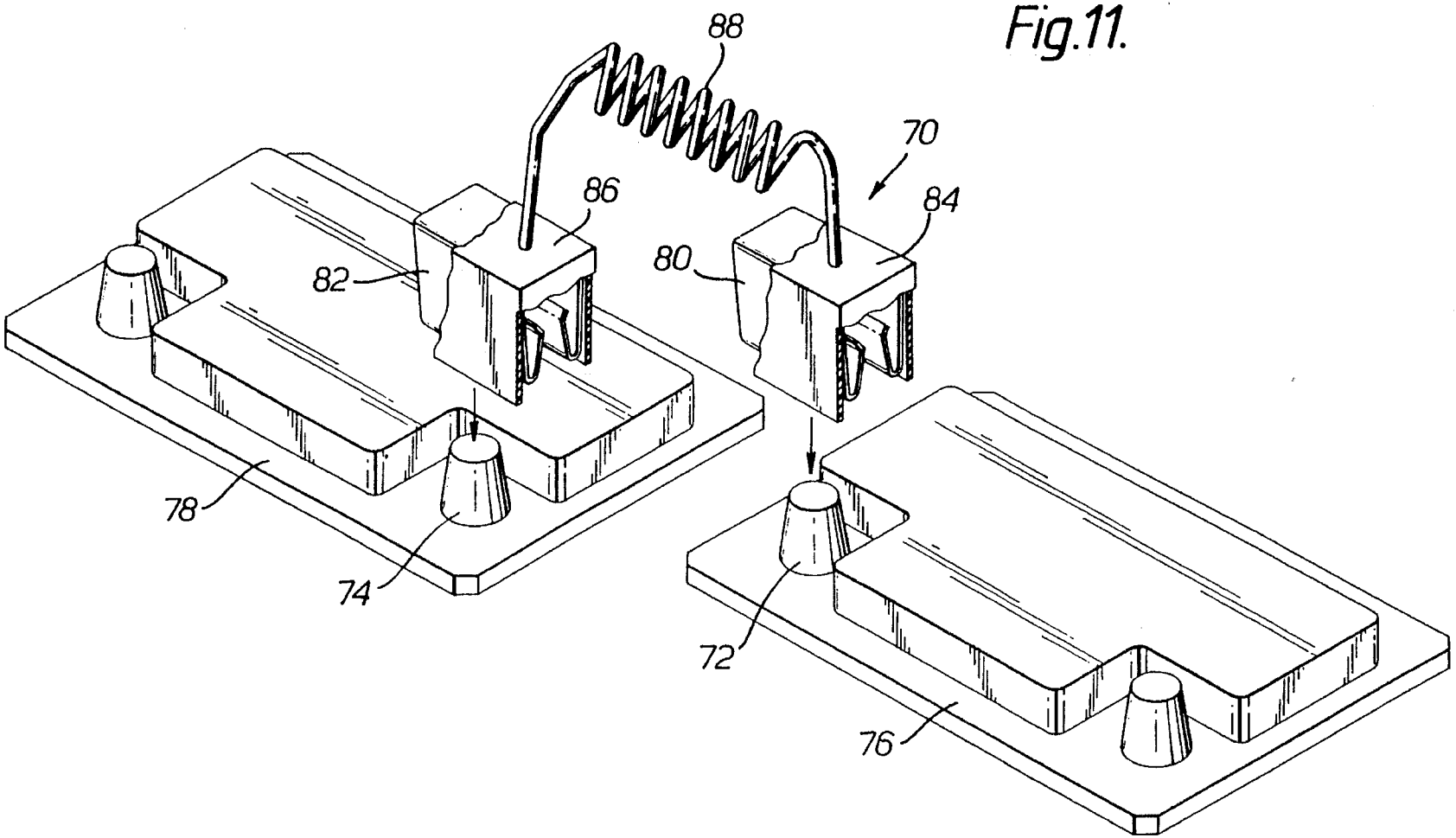
FIG. 11 is a perspective view, partly cutaway, of a second embodiment of electrical connector in accordance with the present invention.

A second embodiment of electrical connector 70 in accordance with the present invention is shown in FIG. 11. The electrical connector 70 is usable where the separation between terminals 72,74 of batteries 76,78 is too large for the electrical connector 10 of FIG. 1; and/or where the batteries 76,78 are not aligned; and/or where the terminals 72,74 are significantly different in size. The electrical connector 70 comprises two separate electric contacts 80,82 which are the same shape as the electric contacts 22 in FIG. 1, but which are sized to fit a respective terminal. Each electric contact 80,82 has its own separate housing 84,86. The electric contacts 80,82 are electrically connected by an electric cable or wire 88 which passes through each housing 84,86 and is secured to the electric contacts. All other aspects of the electric contacts 80,82 and the housings 84,86 are the same as for the electric contacts 22 and housing 44 of FIG. 1.

Figure 12:
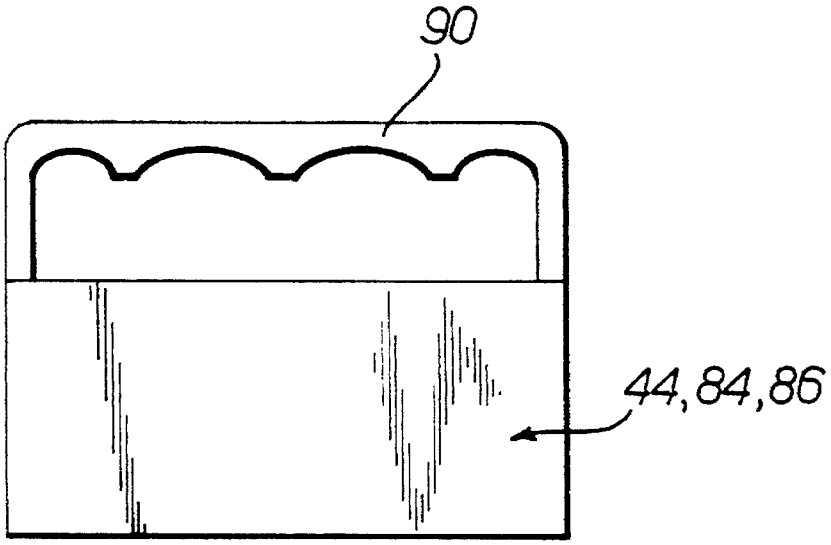
FIGS. 12 and 13 are illustrations of modifications which can be made to the housing of an electrical connector in accordance with the present invention.
Figure 13:
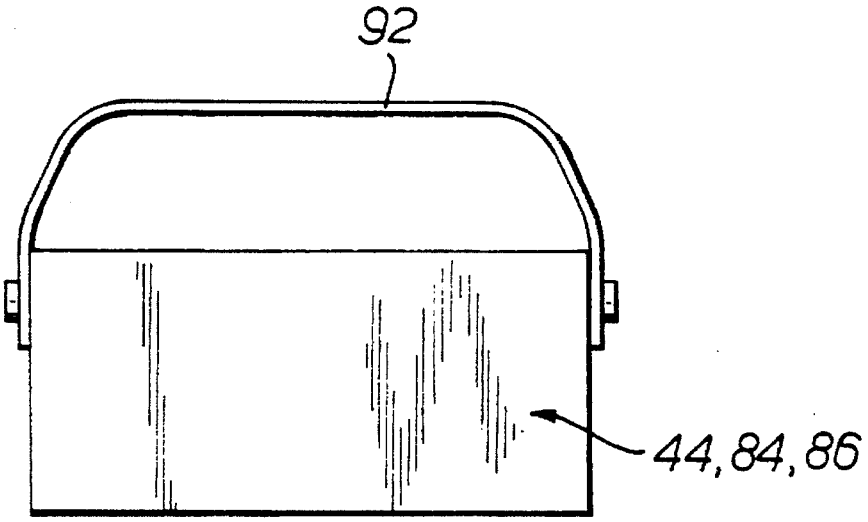

FIGS. 12 and 13 illustrate modifications which can be made to the housings 44,84,86 of FIGS. 1 and 11. In FIG. 12, a handle 90 is integrally moulded with the housing. In FIG. 13, a handle 92 is formed separately and attached to the housing by any suitable means.

Figure 14:
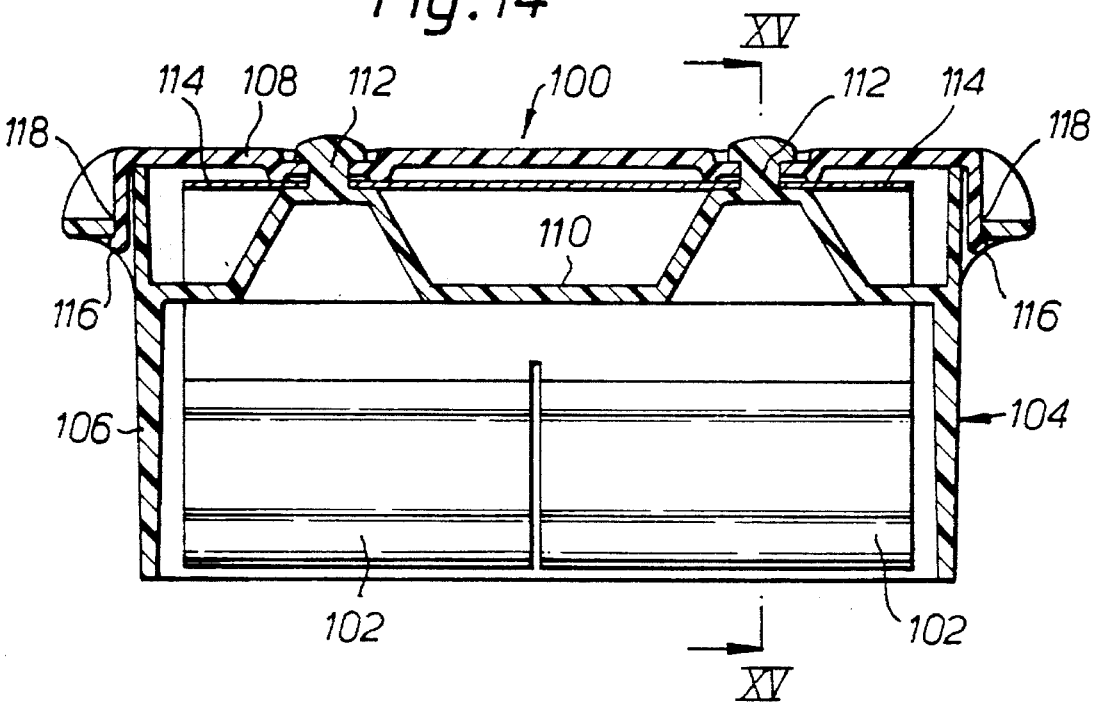
FIG. 14 is a cross-sectional view of a third embodiment of electrical connector in accordance with the present invention.
Figure 15:
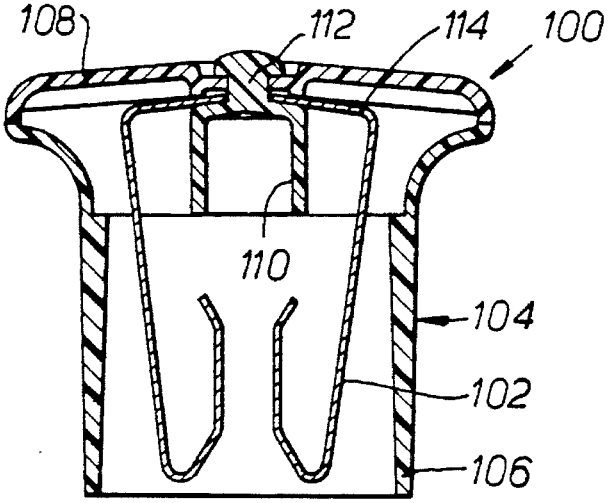
FIG. 15 is a cross-sectional view on the line XV—XV of FIG. 14.

A third embodiment of electrical connector 100 in accordance with the present invention is shown in FIGS. 14 and 15. In this embodiment, the electrical connector 100 comprises a pair of electric contacts 102 which are substantially the same as the electric contacts of the electrical connector of FIG. 1, and a housing 104. The housing 104 is formed in two parts and comprises a substantially tubular portion 106 and a cover portion 108. The tubular portion 106 has a substantially rectangular cross-section and surrounds the electric contacts 102. The tubular portion 106 has a rail member 110 extending diametrically across the longest dimension, the rail member 110 having a pair of upstanding pegs 112. The base portion 114 of each electric contact 102, and the cover portion 108 of the housing 104 having apertures which correspond to the pegs 112. The electrical connector 100 is assembled by positioning the electric contacts 102 on the pegs 112, and then positioning the cover portion 108 on the pegs. The cover portion 108 also has a pair of legs 116 which latch behind corresponding apertures 118 in the tubular portion 106 on assembly. After assembly, the ends of the pegs 112 are melted over to secure the cover portion 108 on the tubular portion 106.

While the invention has been described in terms of certain specific embodiments thereof, it is not intended to be limited thereto but rather only to the extent set forth hereafter in the claims which follow.

The embodiments of the invention in which an exclusive property or privilege is claimed is defined as follows:

1. An electrical connector adapted to slide on and off a battery terminal having a known minimum diameter, said connector comprising an electric contact of electrically conductive material having a longitudinal axis and a substantially U-shaped cross-section transverse said axis, said contact being defined by a base portion and a pair of resilient legs extending away from the base portion, said legs each having a distal portion bent backwardly on its associated leg and inwardly of said legs to form a pair of resilient arms directed back towards the base portion, said arms being spaced apart from each other and converging on each other to define a longitudinally extending slot therebetween, said slot having a first inner width which is less than said diameter and a second outer width which is greater than said diameter, and a housing of electrically insulating material surrounding the electric contact and having an opening adjacent the slot adapted to receive the battery terminal.

2. An electrical connector as claimed in claim 1 wherein said contact is long enough to engage at least two terminals on adjacent batteries.

3. An electrical connector as claimed in claim 1 wherein the housing has a handle.

4. An electrical connector as claimed in claim 1 comprising two discrete electric contacts electrically connected together, each electric contact having a separate housing.

5. An electrical connector as claimed in claims 1 to 4, wherein the housing comprises two parts which are secured together.

6. An electrical connector as claimed in any one of claims 1 to 4, wherein the electric contact is formed in one piece from sheet metal.

7. An electrical connector as claimed in claim 6, wherein said metal is stainless steel.

8. An electrical connector as claimed in claim 1 wherein said legs converge upon each other remote from said base portion.

9. An electrical connector as claimed in one of claims 1–4 and 8 wherein said arms each includes a segment which substantially parallels a like segment on an opposing arm and is spaced apart from said like segment by a distance equal to about said inner width for engaging a side of said terminal along a length of said side.

* * * * *